United States Patent [19]

Fapiano

[11] 4,149,395

[45] Apr. 17, 1979

[54] METHOD AND APPARATUS FOR CORRECTING CAMBER IN ROLLED METAL WORKPIECE

[75] Inventor: Donald J. Fapiano, Salem, Va.

[73] Assignee: General Electric Company, Salem, Va.

[21] Appl. No.: 863,846

[22] Filed: Dec. 23, 1977

[51] Int. Cl.[2] ..... B21B 37/00
[52] U.S. Cl. ..... 72/11
[58] Field of Search ..... 72/6-12, 72/16, 21; 73/159

[56] References Cited

U.S. PATENT DOCUMENTS

| | | | |
|---|---|---|---|
| 3,006,225 | 10/1961 | Mamas | 72/12 |
| 3,081,651 | 3/1963 | Roberts | 72/9 |
| 3,213,655 | 10/1965 | Reid | 72/11 |
| 3,245,241 | 4/1966 | Roberts | 72/9 |
| 3,470,739 | 10/1969 | Tahafuji et al. | 73/159 |
| 3,518,441 | 6/1970 | Selgin | 250/219 |
| 3,934,438 | 1/1976 | Arimura et al. | 72/9 |

*Primary Examiner*—Milton S. Mehr
*Attorney, Agent, or Firm*—Arnold E. Renner

[57] ABSTRACT

A method and apparatus for correcting camber occurring during the rolling of a flat metal workpiece employs individual end adjustment of the work roll gap in response to the amount of camber detected.

15 Claims, 7 Drawing Figures

METHOD AND APPARATUS FOR CORRECTING CAMBER IN ROLLED METAL WORKPIECE

BACKGROUND OF THE INVENTION

The present invention relates generally to metal rolling mills and more particularly to a method and apparatus of correcting camber in a rolled metal workpiece.

Camber, as the term is employed in the present specification, refers to a curvature along the length of a metal workpiece which often becomes more pronounced as the length increases and is usually the result of a greater elongation along one side of the workpiece than along the other side. The workpiece then assumes, when viewed from the top, a generally arcuate configuration.

Camber in a rolled metal workpiece results in waste, in the case of plate products, and stand threading or coil entry problems, in the case of tandem mills. The waste in plate product results from the additional side scrap when shearing rectangular plates from the curved, untrimmed "pattern". This additional scrap must be allowed for in the target dimensions for the rolling operation. Inadequate allowances will increase underwidth rejects. Both the added allowance and the increased rejects reduce process yield making it important to minimize the average rolled camber. In tandem rolling stands, severe camber or curvature may prevent proper threading of subsequent stands or coilers.

It has been past practice to provide camber correction through operator intervention. That is, the mill operator by visual inspection observed the workpiece and, based upon his experience and judgment, adjusted the mill work rolls. This has resulted in production losses either through reduced threading speeds necessary to accommodate the operator's manual corrections, or through direct material loss where these correction were inadequate.

SUMMARY OF THE INVENTION

It is, therefore, an object of the present invention to provide an improved apparatus and method for camber correction of a workpiece in a metal rolling mill.

It is a further object to provide for camber correction in a more accurate and precise manner without placing undue reliance upon the experience and ability of an operator.

Still another object is to provide an apparatus and method for camber correction which is subject to automation.

The foregoing and other objects are satisfied in accordance with the present invention through the determination of the amount of camber in a given length of workpiece with further determinations as to the workpiece width, edge thickness, and, where appropriate, deformation resistance, and the mill and roll deformation rates. On the basis of these determinations, calculations to determine the edge-to-edge thickness difference which will account for the observed camber are made and from these calculations a determination of the change in screw position necessary to produce the desired thickness correction to offset the camber are effected and utilized in setting the work roll position screws.

BRIEF DESCRIPTION OF THE DRAWING

While the present invention is defined in particularity in the claims annexed to and forming a part of this specification, a better understanding can be had from the following description taken in conjunction with the accompanying drawing in which:

DETAILED DESCRIPTION

Figure 1:
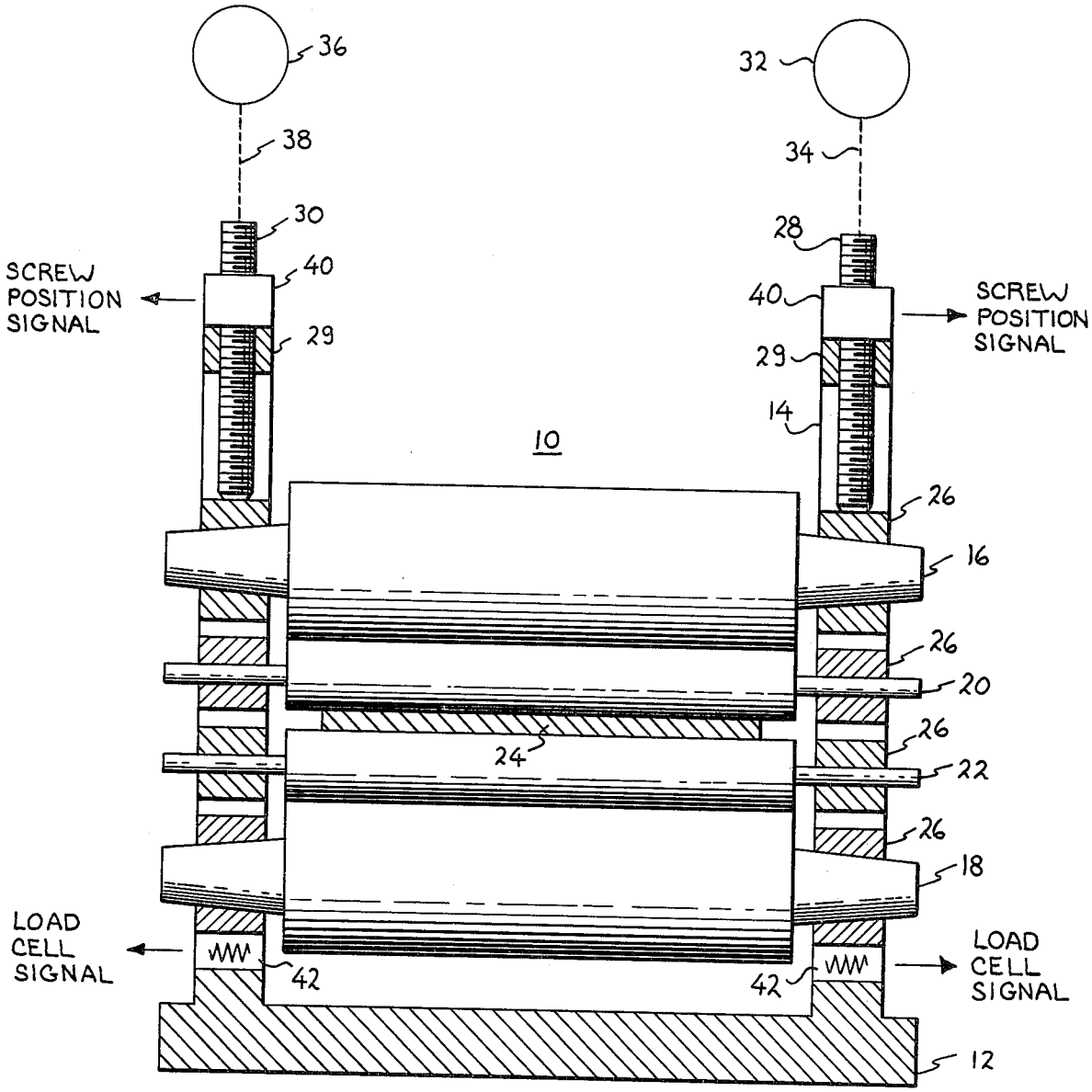
FIG. 1 is a diagrammatic view, partially in section, illustrating a typical 4-high mill stand such as might be used with the present invention.

Referencing now FIG. 1, there is shown a 4-high mill stand 10 in accordance with known design and such as might be utilized in the practice of the present invention. The stand 10 includes a base 12 and a pair of upright portions 14 to support the rolls of the stand. In that this is a 4-high stand, there are included an upper backup roll 16 and a lower backup roll 18 as well as upper and lower work rolls 20 and 22, respectively. A workpiece 24 is passed between the work rolls 20 and 22 to effect a reduction in the thickness of the workpiece. Each of the rolls 16, 18, 20 and 22 is supported for rotational and vertical linear motion by means of appropriate bearing chocks 26. The position of the rolls is determined by suitable means, illustrated in FIG. 1 as a pair of screws 28 and 30 supported by the upper part 29 of the stand. In the type of mill shown in FIG. 1, the position of the screws is adjusted as a function of the independent action of two motor means shown, respectively, as motors 32 and 36. Motor 32 drives the screw 28 by some mechanical means indicated by the dashed line 34 while screw 30 is adjusted through the operation of motor 36 and a mechanical connection indicated by the dashed line 38. Under the operation of the motors 32 and 36, in response to appropriate controls to be later explained, the positions of the two screws and hence the positions of the ends of the rolls are independently adjustable. The actual position of the screws is indicated, as illustrated in FIG. 1, by means of two screw position sensors shown in block form at 40 which can be any of those devices well known in the art designed and operable to generate and transmit a signal indicative of the screw position. While screws have been shown in this particular embodiment, it is to be expressly understood that other means, such as hydraulic means with appropriate position sensing devices, may be used in place of the illustrated screws with equal facility and application to the present invention. It is, therefore, to be expressly understood that the term screws, as used in this specification, is to be considered as a generic term for the roll positioning means.

As the workpiece 24 is passed between rolls 20 and 22, the forces exerted on the rolls may be measured. In the embodiment illustrated in FIG. 1, this measurement is provided by a pair of load cells 42 positioned between the base 12 and the chocks of the lower backup roll 18. The load cells 42 are customarily some form of strain gage which outputs a signal proportional to the forces exerted thereon. In FIG. 1, the cell output is designated "Load Cell Signal". It is also known that the load cells can be located in positions other than those shown and they are, for example, often located between the bottom of the screws 28 and 30 and the chocks 26 of the upper backup roll 16.

Just as the screws illustrated in FIG. 1 can be replaced by other means such as hydraulics and the load cells can be positioned other than as shown, it should be noted that while a 4-high stand has been shown in FIG. 1, it is known in the art to provide what is known as a 2-high stand in which there are no backup rolls and in which there is but a single pair of work rolls. In such a stand, it is normal to proportion the work rolls relatively larger than is here illustrated. Whether the stand is a 2-high or a 4-high is, however, of no direct conceptual importance to the present invention and this invention has equal applicability to either type of known mill stand. There are, however, as will be more fully understood as this description proceeds, differing considerations between 2-high and 4-high stands.

Figure 2:
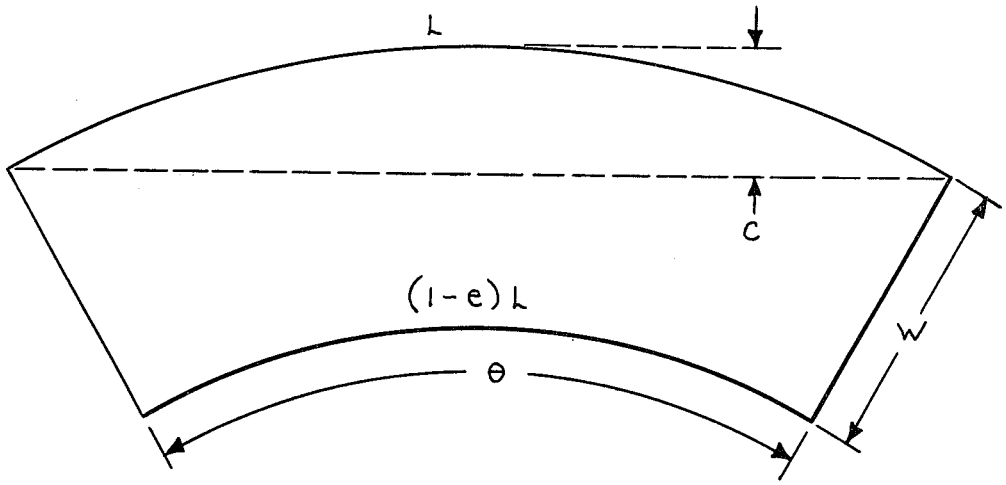
FIG. 2 is a diagrammatic top plan view of a workpiece illustrating camber.

FIG. 2 shows in top plan view a rolled metal workpiece which has experienced camber which is shown highly exaggerated for illustrative purposes. The workpiece as shown in FIG. 2 is of a width W and has a major length L and a minor length which may be expressed as (1−e)L. In this case the term "e" is the elongation error; that is, the difference between the length of sides per unit. The camber is illustrated in FIG. 2 by "C" and it is seen that it is that distance which separates two parallel lines, one joining two corners along the length of the workpiece and the second line drawn tangent to the curvature of the workpiece. From pure geometry, if it is assumed that in FIG. 2 the side "L" is an arc of a circle, the camber C may be expressed by the equation:

$$C = W/e(1-\cos 28.7\, eL/W) \quad (1)$$

wherein:

C=camber

W=width

L=length e=elongation error (per unit difference in side length).

Expressing e in mathematical terms:

$$e = L-[(1-e)L]/L \quad (2).$$

If camber is expressed as a function of some convenient defined length of the workpiece; e.g., camber in inches (C″) per 100 ft., then equation (1) becomes:

$$C''/100' = W/e(1-\cos 28.7e1200/W) \quad (3).$$

Equation (3) can be reduced to (approximately):

$$e = C'' \times W''/180{,}000 \quad (4),$$

where W is also expressed in inches.

Figure 3:
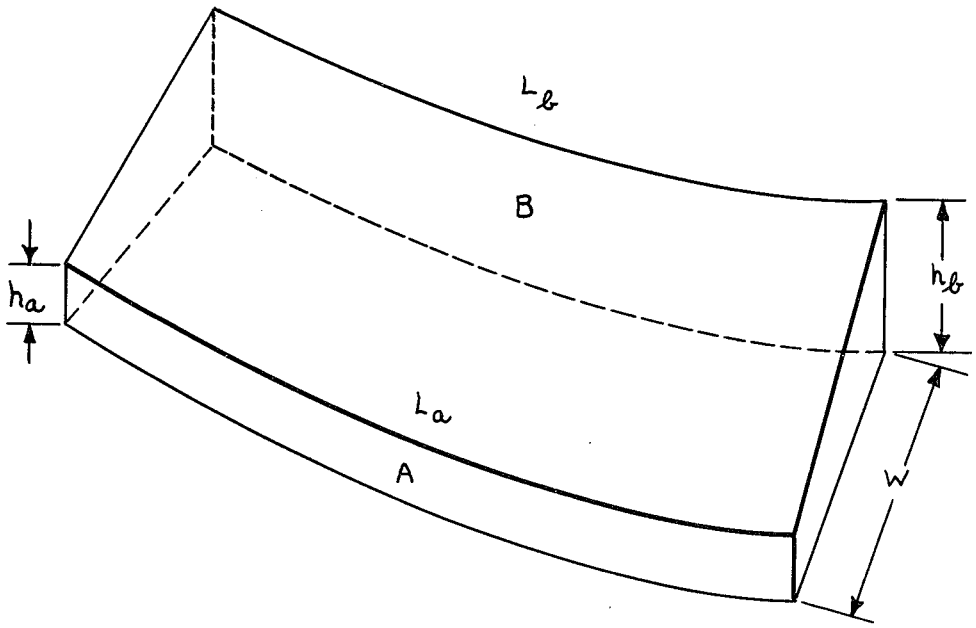
FIG. 3 is a diagrammatic view in perspective form illustrating a workpiece having camber.

The term "e" was earlier stated to be elongation error and equation (2) was so expressed. The correction of camber, however, requires that operations be performed on the workpiece thickness. That there is a direct relationship between workpiece edge thickness and the elongation error may be best explained with the assistance of the FIG. 3 depiction. FIG. 3 illustrates a workpiece which has experienced camber and which is shown in exaggerated form. In FIG. 3, the length $L_a$ corresponds to the length L in FIG. 2, while the length $L_b$ corresponds to the length (1−e)L. In FIG. 3, the workpiece again has a width W. The edge thickness on the longer workpiece side is designated $h_a$, while the edge thickness on the shorter side of the workpiece is designated by $h_b$. The edge surface areas are designated, respectively, in FIG. 3 by the reference characters A and B, with A being the surface of the longer side and B being the surface of the shorter side. If now it is assumed that the workpiece started off as a perfect rectangular solid and that in the reduction pass resulting in the workpiece shape shown in FIG. 3 there was no latteral flow of material and that all the deformation went into elongation (an assumption which is reasonable when the workpiece is in the latter stages of reduction and the width has been essentially stabilized or is being held to a set value), then upon the basis of earlier definitions and use, if equation (2) is expressed in FIG. 3 terminology:

$$e = (L_a - L_b/L_a) = 1 - L_b/L_a \quad (5)$$

Since, as previously assumed, all deformation at the last pass went into elongation, $$A = B \quad (6)$$

As such, $$L_a h_a = L_b h_b \quad (7)$$

and, $$L_b/L_a = h_a/h_b \quad (8)$$

Substituting equation (8) into equation (5):

$$e = 1 - h_a/h_b \quad (9)$$

or, $$e = \Delta h/h_b \quad (10)$$

wherein, Δh is equal to the difference in edge thickness ($h_b - h_a$).

Substituting equation (10) into equation (4) gives:

$$\Delta h = C \cdot W \cdot h_b/180{,}000 \quad (11)$$

wherein, Δh, C, W and $h_b$ are all expressed in inches.

From equation (11) it is seen that the difference between the edge thicknesses, Δh, can be calculated from workpiece dimensions which are readily measurable. It is to be realized that the difference in Δh is, in reality, very small and in this respect FIG. 3 is somewhat misleading, emphasis being intentional to demonstrate the point. The dimension W if not known is, of course, readily measurable. The dimension $h_b$ which is actually the thicker edge thickness is measurable by such means as X-ray gages or it may be calculated by well-known equations involving force roll opening, mill stretch, etc. Whether or not the term $h_b$ is actually the thicker edge thickness or some intermediate thickness will not seriously affect the calculation of the difference in thickness Δh due to the fact that, as was previously indicated, the difference between the thin edge and the thick edge will be relatively small, for example 0.001 inches.

Knowing the thickness $h_b$ and the width W, the remaining term to be determined before the desired quantity h can be calculated is that of camber (C). Δh, as will be explained later, is the change in relative edge thickness and will govern the amount that a one of the screws 28 or 30 of the mill in FIG. 1 must be adjusted away from its normal setting for the next pass of the workpiece through the mill stand (or an adjustment to the current setting of the stand delivering the cambered workpiece in a tandem mill) in order to achieve camber correction. One way in which the camber dimension C could be obtained would be by visual operation by the operator. That is, the operator could "eye" the workpiece as it emerges from the mill stand and based upon his experience and judgment decide that the camber was a given amount in a known length. The operator would then "key" this information into a suitable calculating device such as a computer which would perform the calculation in accordance with other known data and in accordance with equation (11) to effect the control of the screws. This method, of course, relies upon the operator's individual ability but is still a vast improvement over that of the prior art in that the operator need judge only the amount of camber. This is a relatively simple matter compared to the expertise required to translate that observation into a screw adjustment change. It is further noted that the vast majority of rolling mills being built today have associated therewith some form of data processing control or computer such that the ability to key in the data and to solve the equation specified by equation (11) would be relatively a simple matter. In the event that the data processing unit or computer were not available, with state-of-the-art of microprocessors today, the achievement for this small computation would be a relatively simple matter.

A second manner in which the dimension C could be achieved would again rely upon a visual observation but would require less experience on the part of the operator. Most steel mills today have facilities for the remote observation of the workpiece by closed circuit television and it would be a relatively simple matter to superimpose a suitable scaled grid onto the front of the television viewing surface to assist the operator in determining the amount of camber which then could be manually keyed into the computer in the manner previously specified.

In order to automate the mill completely, however, and to achieve more rapid and accurate results without depending upon the experience and skill of any operator, the dimension C could be determined through the use of any of the various optical scanner or area imaging devices readily available on the market today. The optical scanner can take many forms but one of the more common is the linear or line scanner which includes a linear photo-diode array which may include, for example, from 64 to approximately 2,000 elements. These elements, when properly focused across the workpiece, would give an accurate representation of its position. The area imaging device amounts basically to a plurality of linear arrays arranged to form a two-dimensional matrix such that an electronic image or dimension could be electronically derived therefrom. As an example of a source of such arrays, they are readily available from such companies as Reticon Corp. of Sunnyvale, California, and the Optron Division of Universal Technology, Inc. of Woodbridge, Connecticut, which sell such arrays under the name "Optigage".

Figure 4:
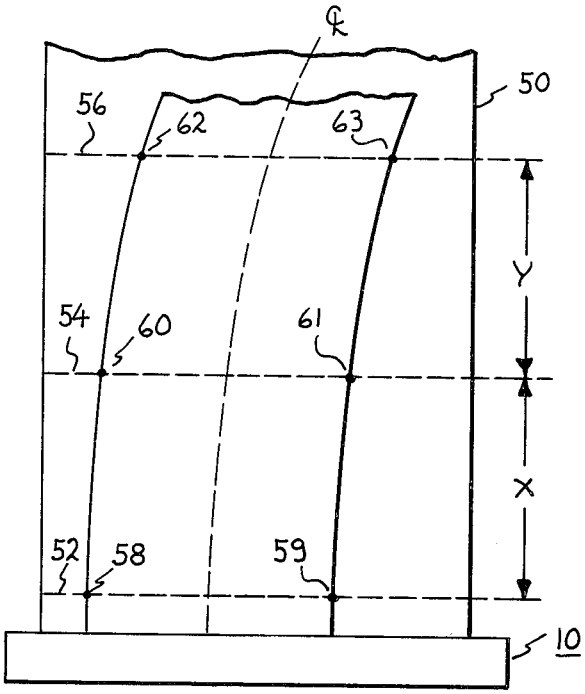
FIG. 4 is a top plan view illustrating a cambered workpiece issuing from a mill stand.

FIG. 4 illustrates how the camber C might be determined in a mill setup using three linear arrays. As shown in FIG. 4, the workpiece 24 is emerging from a mill stand 10 onto a runout table 50. In its simplest form, the measurement system for camber would include three linear arrays indicated, respectively, by the dashed lines 52, 54 and 56. These arrays would be placed above the table (see FIG. 5) and designed to "look" across the width of the workpiece. When the workpiece 24 reaches a position such as is indicated in FIG. 4, i.e., the workpiece 24 is beneath all three arrays, the indications or readings from these gages could then be taken so as to determine the six points shown as 58 to 63 corresponding to both edges of the workpiece 24. With knowledge of the relative location of each of the points 58 to 63 coupled with the knowledge of the distances X and Y (representing, respectively, the distances between the scanning arrays 52 and 54 and arrays 54 and 56) the camber (C) can be readily calculated. Preferably this calculation references the workpiece centerline (℄)to a fixed line such as the edge of the runout table 50 to make this determination. The use of the centerline as opposed to a workpiece edge for camber calculations is preferred due to the fact the workpiece width may not be constant over the length being measured and as such the centerline type of calculation results in greater accuracy. (For example, the workpiece may have a generally convex shape along its length which would introduce inaccuracies if the edge were used.)

With the dimensions known, it is a relatively simple process to solve equation (11) for the term Δh. This, as was previously indicated, would normally be done in some form of computational device as a computer associated with the mill. It is to be realized, however, that the term Δh is the amount of change which must be reflected in the rolls at the workpiece edge and not the amount of screw position adjustment or offset. This is readily seen, with respect to FIG. 1, in that the workpiece 24 is narrower than the centerline distance between the two screws 28 and 30. As such, the term Δh may be correlated to the offset of the screw positions by a simple proportioning of the workpiece width to the distance between the centerline screw. Thus, for the next pass, the screw correction or offset ΔS, which is necessary to correct camber, may be expressed as:

$$\Delta S = \Delta H \cdot K / W \qquad (12)$$

wherein,

K=distance between screw centerlines

W workpiece width.

It should be noted that the screw offset, ΔS, is the change in one screw position which will produce the required camber correction. For more rapid correction, it is customary to adjust both screws by equal and opposite amounts. In that case, one screw would be offset by +66 S/2; the other would be offset by −ΔS/2.

The term ΔS was stated to be a screw or work roll gap offset and it must be remembered in this regard that in a single-stand reversing mill or in a tandem rolling mill the roll gaps are established first in accordance with a rolling schedule to produce, at the end of the rolling schedule, a sheet or plate of desired thickness. Thus, the term ΔS is not a screw setting, per se, but is an offset to correct camber and is, therefore, combined with the normal roll setting in any appropriate manner such as that to be described with respect to FIG. 5. One final comment concerning the term ΔS should be made. Employing ΔS in the manner just calculated in order to derive the offset assumes a perfectly rigid mill such that any change ΔS seen by the roll gap will be affected in the metal. As is well known in the art, this is not necessarily true in that a mill is not a perfectly rigid structure but does exhibit stretch at various points. As such, the total roll position change will not be seen as an actual change in the workpiece reduction. (This is analogous to stretch in the well-known automatic gage control mill operation but does differ somewhat as will be further explained as this description proceeds.) It is, however, permissible to use the ΔS term without further modification in a reversing mill where multiple passes are yet to be made such that by maintaining the offset on the same rolls, the error introduced by the mill stretch will tend to relatively diminish and reduce itself to zero.

Figure 5:
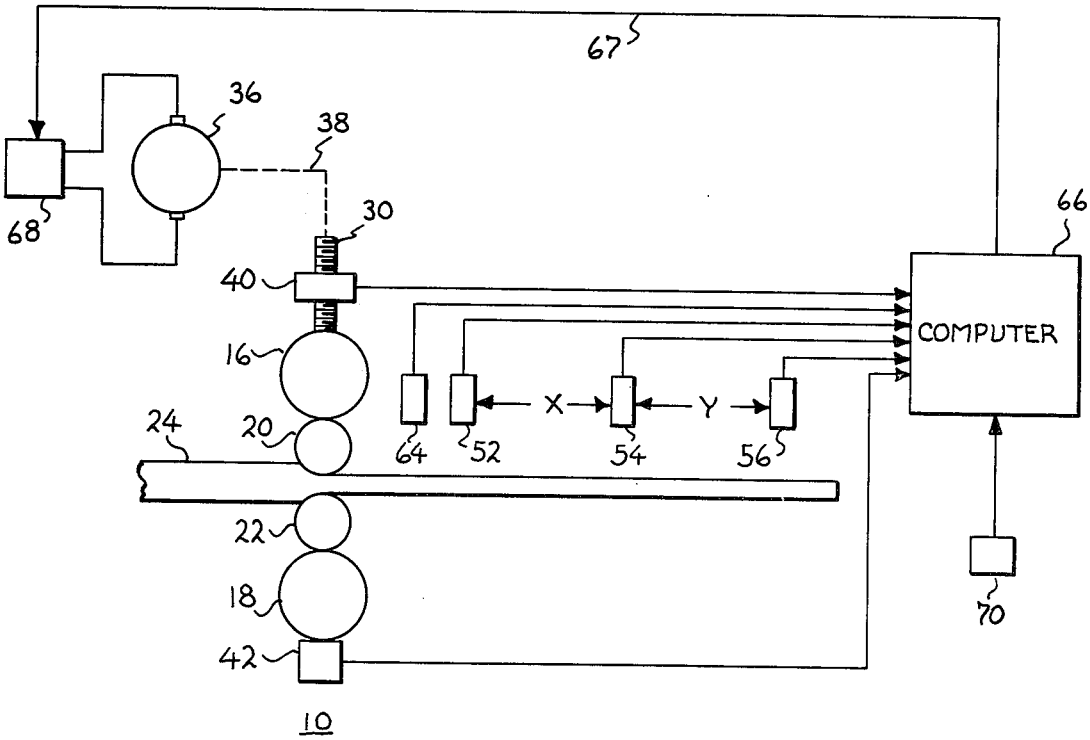
FIG. 5 is a diagrammatic view of a metal rolling mill and associated equipment for operation in accordance with the present invention.

FIG. 5 illustrates one means of implementing the present invention to provide a completely automatic camber correction system. In FIG 5 those elements previously described in the other figures are designated by the same reference characters as previously used. Thus, as shown in FIG. 5, the mill stand 10 includes backup rolls 16 and 18 and work rolls 20 and 22 for rolling the workpiece 24. Also shown are one load cell 42 and one screw 30 with its associated motor 36, drive 38 and position detector 40. Taking devices 40 and 42 to represent both sides of the mill, it is seen that the signals derived therefrom are provided to a suitable computer or computing device 66 which may be any of those well known in the art and which in a completely automated mill may be, for example, a Honeywell computer of the 4000 Series. (Obviously, a computer having the capability of a Honeywell 4000 Series would not be required to implement the present invention, but such a computer might already be present and in use to control in total one or more mills such as is being here used as an example.) A further input to the computer 66 is shown from an X-ray gage 64 which may be positioned near the mill stand 10 to provide a signal representing the thickness of the workpiece 24 as it emerges from the mill. (The thickness could also be derived by other methods such as from force calculations as previously discussed.) Device 64 could also, or in the alternative, represent a suitable width gage of any known type to provide to the computer an indication of the width of the strip 24 leaving the stand, although extremely accurate knowledge of width is not essential to the invention and may be replaced with the scheduled, or "target", rolling width. Three devices 52, 54 and 56 corresponding to the depiction in FIG. 4 represent the linear arrays to provide an output, probably by way of an associated processing unit, to the computer such that there is provided therefrom dimensions which the computer can use to calculate the camber C. The last input to the computer is shown from a device 70 which may be a suitable terminal input such that, if desired or known, factors may be entered into the computer for the overall computations to be derived. In response to the input signals, the computer 66 will perform the requisite calculations and will provide as an output on a line 67 a signal to a suitable control 68 for the motor 36 to move the screw 30 by an amount which is calculated in accordance with established setup practices and by the offset ΔS.

Earlier mention was made of the mill stretch and it was indicated that the total effect of the screw offset would not be seen by the workpiece. In a reversing mill, as earlier stated, the multiple passes through the same rolls tend to reduce this error to zero. The same does not hold true, however, for a tandem mill and the analogy was drawn to an automatic gage control system where the mill "modulus" must be accounted for in correcting gage errors. It is, however, recognized that in the camber correction situation, because the correction is asymmetric across the workpiece width, the stretch "effects" will be different from those in the gage control situation. The following description will consider the housing stretch and workpiece and roll interface deformations as they apply in camber corrections. (In a 4-high mill, there would be two such interfaces on each side, one between the workpiece and the work roll and one between the work roll and the backup roll. In a 2-high stand only two such interfaces exist, one on each side between the workpiece and the work roll.)

Figure 6:
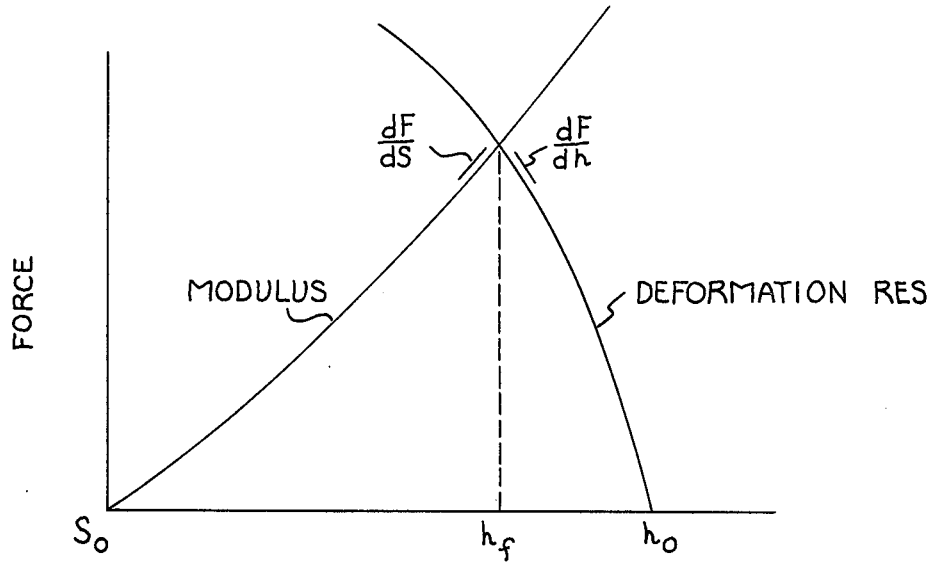
FIG. 6 is a state-of-the-art graph relating deformation and elasticity to rolling force; and, FIG. 7 is a diagrammatic view illustrating force and deformation characteristics which are useful in understanding the present invention.

In regard to the automatic gage control problem to which reference was previously made, and to which the present description is analogous, the relationship or "transfer function" between screw change and gage control may be obtained from the elastic characteristic of the mill and the plastic characteristic of the workpiece. These characteristics may be and usually are graphically represented as shown in FIG. 6 which plots force as a function of deformation. The curves of FIG. 6 are those which are well known in the art and customarily result from empirically derived data concerning the mill (modulus curve) and the workpiece material (deformation resistance curve). The slope of the modulus curve in the region of the rolling force is dF/dS and the slope of the deformation resistance curve is dF/dh. In the automatic gage control situation, the relationship between a screw change and a corresponding gage change may be expressed as:

$$dS/dh = dF/dh \cdot dS/dF \qquad (13).$$

Figure 7:
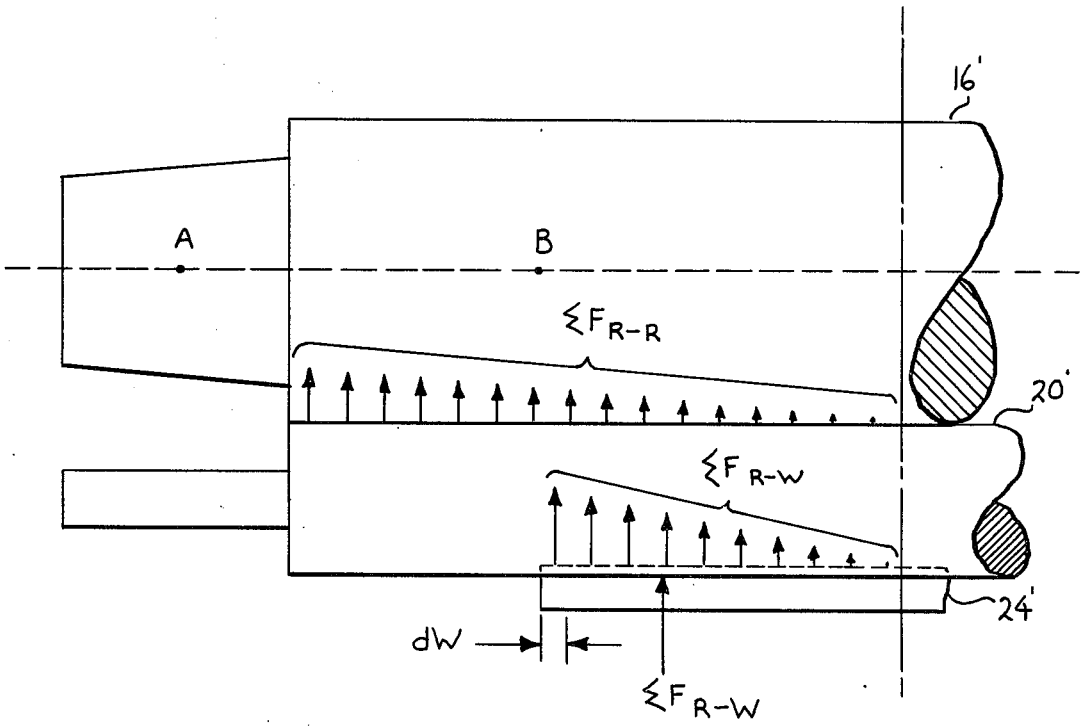

In the camber correction situation with which the present invention is concerned, the same constituent deformations are present but in different proportions because the force distribution is tapered as illustrated by the arrows shown in FIG. 7. The major influences to be considered here are those associated with the interface deformations; i.e., workpiece to work roll and work roll to backup roll. The housing deformation is smaller but may be easily included. The change in force distribution also results in some distortion of the axial deformation but this change is very complicated and, because it is also very small in comparison to the other deformations, may be ignored for control purposes.

FIG. 7 shows portions of a backup roll 16', a work roll 20' and a workpiece 24'. The force distributions illustrated in FIG. 7 assume camber correction by equal and opposite adjustments of the two screws. Looking first at the work roll/workpiece interface, consider an increment of width (dW) at the workpiece edge. The force necessary to deform this element a small amount (dF/dh) is the well known deformation resistance and is available from standard "set-up" models for materials being processed as was discussed earlier with respect to FIG. 6.

The deformation of the work roll at a point corresponding to this element is known from rolling theory. For example, Hitchcock gives the deformation rate as:

$$\frac{dD_{W-R}}{dF} = \frac{2\delta}{d} + 2\delta \log_e \frac{2D}{\sqrt{R' \Delta h}} \qquad (14)$$

wherein:

$dD_{W-R}/dF$ = Workpiece-roll interface deformation rate $\delta = 1 - v^2/E$ v = poisson's ratio E = roll modulus of elasticity D = undeformed work roll diameter R' = deformed work roll radius $\Delta H$ = draft.

If the mill were only 2-high, this deformation rate and the mill housing deformation would be used directly as a modifier to determine the required screw movement.

When, however, the mill is a 4-high, as are most finishing mills, the work roll/backup roll interface deformation must also be considered. This determination is simplified by observing (FIG. 7) that the total force change at the roll-roll interface ($\Sigma F_{R-R}$) must equal the total force ($\Sigma F_{R-W}$) change at the roll workpiece interface. At a point on the roll-roll interface directly over the workpiece edge, the pressure is simply the pressure at the workpiece edge reduced by the ratio of the workpiece width divided by the backup roll length.

The deformation rate at the roll-roll interface ($dD_{R-R}/dF$) is known from Hertz's theory, as one example, as:

$$\frac{dD_{R-R}}{dF} = \frac{2}{3\pi}\left\{\left[\frac{(1-\nu_1^2)}{E_1}\left(1+3\log_e\frac{2D_1}{b}\right)\right]+\left[\frac{1-\nu_2^2)}{E_2}\left(1+3\log_e\frac{2D_2}{b}\right)\right]\right\} \quad (15)$$

wherein:

$\nu_1$ = poisson's ratio for backup roll
$\nu_2$ = poisson's ratio for work roll
$E_1$ = backup roll modulus of elasticity
$E_2$ = work roll modulus of elasticity
$D_1$ = undeformed backup roll diameter
$D_2$ = undeformed work roll diameter
b = contact length between rolls.

Since the pressure change at the roll-roll interface is reduced from that at the workpiece edge, the deformation at a point corresponding to the workpiece edge will also be reduced. Thus, the total interface deformation, $dD_\Sigma/dF$, directly above the workpiece edge can be expressed as:

$$\frac{dD_\Sigma}{dF} = \frac{dD_{R-W}}{dF} + \frac{W}{\text{Roll Length}}\cdot\frac{dD_{R-R}}{dF}. \quad (16)$$

To the value derived from equation (16) there must be added the translation or shift of point B (see FIG. 7) due to the housing stretch at point A. It will be recognized that since the total force on the mill remains unchanged, when one side of the mill sees an increase in force, the other side will see a decrease. The stretch change due to the force couple at the workpiece must, however, be considered. As such, the total force change ($\Sigma F_{R-W}$) on one-half of the workpiece is:

$$\Sigma F_{R-W} = \Delta h \cdot dF/dh \cdot W/2 \cdot \tfrac{1}{2} \quad (17).$$

If it is assumed that the force change distribution is triangular as shown in FIG. 7 (an assumption which while not exactly correct is sufficiently accurate to make any errors introduced negligible), the distributed force may be considered as a single force acting at a point located two-thirds of one-half the width from the mill centerline. This force is illustrated by the arrow $\Sigma F_{R-W}$ in FIG. 7. The force change ($\Delta F_c$) due to this force as seen at the screw down centerline (point A) is:

$$\Delta F_c = \Sigma F \cdot W/3 1K/K/2 \quad (18).$$

Substituting equation (17) into equation (18) gives:

$$\Delta F_c = \Delta h \cdot \frac{dF}{dh}\cdot\frac{W}{4}\cdot\frac{2}{3}\ \frac{W}{K}, \text{ or,} \quad (19)$$

$$\Delta F_c = \Delta h \frac{dF}{dh}\cdot\frac{W^2}{6K}. \quad (20)$$

The deformation ($\Delta D_H$) of one side of the housing under this force is:

$$\Delta D_H = \Delta F_c / M_H/2 \quad (21)$$

wherein: $M_H$ = total housing modulus of elasticity.

This deformation as seen at point B in FIG. 7, expressed as $\Delta D_{H-B}$ is, by proportion:

$$\Delta D_{H-B} = \frac{2\Delta F_c}{M_H}\cdot\frac{W}{K}. \quad (22)$$

From equation (22) it may be stated that:

$$\frac{dD_{H-B}}{dF_c} = \frac{2W}{M_H\cdot K}. \quad (23)$$

Equation (23) gives the rate of deformation at a point above the strip edge due to the force change at the screws acting through the housing modulus. Since, however, other deformation terms have been expressed in terms of force per unit width change at the workpiece edge, this component should also be so related and, therefore:

$$\frac{dD_{H-B}}{dF} = \frac{dD_{H-B}}{dF_c}\cdot\frac{dF_c}{dF}. \quad (24)$$

Since the equation (20) it may be said that:

$$\frac{dF_c}{dF} = \frac{W^2}{6K}, \text{ it follows that:} \quad (25)$$

$$\frac{dD_{H-B}}{dF} = \frac{W^2}{6K}\cdot\frac{2W}{M_H K} = \frac{W^3}{3K^2M_H}. \quad (26)$$

If this latter component is now added to the deformation expression as set forth in equation (16), the result for expressing total deformation is:

$$\frac{dD_\Sigma}{dF} = \frac{dD_{R-W}}{dF} + \frac{W}{\text{Roll Length}}\cdot\frac{dD_{R-R}}{dF} + \frac{W^3}{3K^2M_H}. \quad (27)$$

The relationship between total deformation of point B (FIG. 7) and workpiece edge reduction will be:

$$\frac{dD_\Sigma}{dF}\cdot\frac{dF}{dh} = \frac{dD_\Sigma}{dh}, \text{ and}$$

the total motion of point B will be:

$$\Delta h + \Delta h\cdot\frac{dD_\Sigma}{dh} = \Delta h\left(1+\frac{dD_\Sigma}{dh}\right) \quad (28)$$

and the screw motion $\Delta S$ required at point A of FIG. 7 to achieve this motion is:

$$\Delta S = \Delta h \left[ 1 + \frac{dD_\Sigma}{dh} \right] \frac{K}{W}. \quad (29)$$

A comparison of equations (29) and (12) leads to the obvious conclusion that the difference is the inclusion of the bracketed term in equation (29). This term acts as a modifier to account for deformations which should be accounted for in tandem mills but which, as was earlier indicated, can be ignored in reversing mills where multiple passes tend to diminish to zero the errors occasioned by ignoring the deformations. In the case of on-line control purposes, it is sufficient to make off-line calculations of this term as a function of width and deformation resistance and to store the same, for example in the store of a computer such as shown in FIG. 5, for on-line calculations in the manner described with respect to FIG. 5. In that the operation of the FIG. 5 system would, in this case, differ from that previously described only by the inclusion of the "modifier" (i.e., the bracketed term of equation 29) further discussion of this nature is believed unnecessary.

The following listing is given, solely as an example and not by way of limitation, to illustrate the relative magnitude of deformation components and required roll position corrections for a plate mill application.

$dD_{R-W}$—$0.25 \times 10^{-6}$ inches$^2$/pound (2 interfaces)
$dD_{R-R}$—$0.56 \times 10^{-6}$ inches$^2$/pound (4 interfaces)
$M_H$—$10^8$ pounds/inch
W—100 inches
K—200 inches
Roll Length — 160 inches
dF/dh—$10^6$ pounds/inch$^2$
h—0.375 inches
$d\Sigma/dF$—$6.833 \times 10^{-7}$ inches$^2$/pound
$d\Sigma/dh$—0.6833 inches/inch
$\Delta$ S—3.366 $\Delta$h
Assuming a camber (C) of 3 inches/100 feet, $$e = \frac{3.100}{180000} = 0.001666, \text{ and}$$

$$\Delta h = 0.000625 \text{ inches}$$

$$\Delta S = 0.00210 \text{ inches, total}$$

(i.e., one screw would be raised 0.00105 inches and the other lowered by the same amount).

Thus, it is seen that there has been shown and described a method and apparatus which is readily adaptable to both reversing and tandem mills and which will accurately correct for camber without the need for experienced operator intervention.

While there have been shown and described what are at present considered to be the preferred embodiments of the present invention, modifications thereto will readily occur to those skilled in the art. It is not desired, therefore, that the invention be limited to the specific arrangements shown and described and it is intended to cover in the appended claims all modifications that fall within the true spirit and scope of the invention.

What is claimed is:

1. For use in a metal rolling mill having a pair of opposed work rolls, a method of correcting camber occurring in a metal workpiece comprising the steps of:

(a) determining the amount of camber in a given length of workpiece;
(b) determining the width and thickness of the workpiece;
(c) calculating the workpiece edge-to-edge thickness difference which will account for the determined camber;
(d) determining the screw position change which will produce the desired edge thickness correction as a function of the edge-to-edge thickness difference and workpiece width;
(e) setting the gap between the opposed work rolls as a function of said determined screw position change; and,
(f) passing the workpiece between said rolls.

2. The method in accordance with claim 1 wherein the edge-to-edge thickness difference is calculated as a function of the camber, workpiece width and workpiece thickness.

3. The method in accordance with claim 1 wherein the determined screw position change serves as an offset to an otherwise determined gap between the opposed work rolls.

4. The method in accordance with claim 1 further including the step of determining a modifier to compensate for workpiece-to-roll, roll-to-roll and mill stand deformations said modifier being employed in the step of determining the screw position change.

5. The method in accordance with claim 1 wherein the amount of camber is determined employing the centerline of the workpiece.

6. For use in a reversing metal rolling mill having a pair of opposed work rolls and roll positioning means, a method of correcting camber in a metal workpiece comprising the steps of:

(a) determining the amount of camber in a given length of workpiece;
(b) determining the width and thickness of the workpiece;
(c) calculating the workpiece edge-to-edge thickness difference which will account for the determined camber;
(d) determining a roll position offset which will produce the desired edge thickness correction as a function of the edge-to-edge thickness difference and workpiece width;
(e) modifying the initial roll position as a function of the determined roll position offset; and,
(f) repeatedly passing the workpiece between the rolls while modifying any rolling schedule roll position settings by said offset.

7. The method in accordance with claim 6 wherein the edge-to-edge thickness is calculated as a function of workpiece camber, width and thickness.

8. The method in accordance with claim 6 wherein the amount of camber is determined employing the centerline of the workpiece.

9. For use in a tandem metal rolling mill having a pair of opposed work rolls and roll positioning means at each of several stands, a method of correcting camber in a metal workpiece comprising the steps of:

(a) determining the amount of camber in a given length of workpiece;
(b) determining the width and thickness of the workpiece;
(c) calculating the workpiece edge-to-edge thickness difference which will account for the determined camber as a function of camber, workpiece width and workpiece thickness;

(d) determining a roll position offset which will produce the desired edge thickness correction as a function of the width, edge-to-edge thickness difference and a modifier to compensate for workpiece-to-roll, roll-to-roll and mill stand deformations;

(e) adjusting the roll position of the stand delivering the cambered workpiece as a function of said offset; and, (f) passing the workpiece through the mill stands.

10. The method of claim 9 as applied to a tandem mill in which the individual stands include only work rolls wherein the rolls position offset is determined as a function of width, edge-to-edge thickness difference and a modifier compensating for deformations of the mill stand and the rolls at the workpiece-to-roll interface.

11. The method of claim 9 as applied to a tandem mill in which the individual stands include both work rolls and backup rolls wherein the roll position offset is determined as a function of width, edge-to-edge thickness difference and a modifier compensating for deformations at the interface of the workpiece and the work rolls, the interface of the work rolls and backup rolls, and at the mill stand.

12. A metal rolling mill comprising:

(a) a pair of opposed work rolls between which a workpiece is passed to effect a reduction in thickness in the workpiece;

(b) independently operable adjusting means associated with each end of the work rolls for setting the gap therebetween; and, (c) means means to control the operation of said adjusting means comprising:

(1) motor means, connected to said adjusting means, operative in response to a control signal, (2) means to determine the amount of camber in a given workpiece length, (3) means to determine the width and thickness of the workpiece, and, (4) computational means for developing said control signal to thereby adjust the gap between said work rolls, said computational functioning to first calculate the workpiece edge-to-edge thickness difference which will account for the determined amount of camber and subsequently determining the amount of adjustment of said adjustment means to change the gap between the work rolls as a function of edge-to-edge thickness difference and workpiece width.

13. The invention in accordance with claim 12 wherein said means to determine the amount of camber comprises optical scanning means positioned adjacent the rolling mill.

14. A metal rolling mill comprising:

(a) a mill stand including a pair of opposed work rolls between which a workpiece is passed to effect a reduction in thickness in the workpiece;

(b) a backup roll associated with each of said work rolls;

(c) adjusting means operable to vary the gap between said work rolls, the adjustment at one gap end being independent of the adjustment at the other end; and, (d) means to control the operation of said adjusting means including, (1) motor means for effecting movement of said adjusting means in response to an applied control signal;

(2) means to determine the amount of camber in a given workpiece length, and, (3) computational means for developing said control signal as a function of the determined camber, workpiece width, workpiece thickness and a modifier for compensating for deformation in said work rolls, backup rolls, and said mill stand.

15. The invention in accordance with claim 14 wherein said means to determine the amount of camber comprises optical scanning means positioned adjacent the rolling mill.

* * * * *